US008667713B2

(12) United States Patent
Baudouin

(10) Patent No.: US 8,667,713 B2
(45) Date of Patent: Mar. 11, 2014

(54) FOOTWEAR WITH A FOOT STABILIZER

(75) Inventor: Alexandre Baudouin, Portland, OR (US)

(73) Assignee: Nike, Inc., Beaverton, OR (US)

( * ) Notice: Subject to any disclaimer, the term of this patent is extended or adjusted under 35 U.S.C. 154(b) by 163 days.

(21) Appl. No.: 13/185,890

(22) Filed: Jul. 19, 2011

(65) Prior Publication Data

US 2011/0271555 A1 Nov. 10, 2011

Related U.S. Application Data

(62) Division of application No. 11/869,511, filed on Oct. 9, 2007, now Pat. No. 8,001,704.

(51) Int. Cl.

| | |
|---|---|
| ***A43B 1/10*** | (2006.01) |
| ***A43C 1/00*** | (2006.01) |
| ***A43B 23/00*** | (2006.01) |

(52) U.S. Cl.
USPC ..... 36/102; 36/107; 36/148; 36/50.1

(58) Field of Classification Search
USPC ..... 36/102, 107, 148, 50.1, 108, 57, 58, 68, 36/69, 149–151
See application file for complete search history.

(56) References Cited

U.S. PATENT DOCUMENTS

| | | | | |
|---|---|---|---|---|
| 2,169,337 | A * | 8/1939 | Davis | 36/11.5 |
| D135,155 | S * | 3/1943 | Huff | D2/916 |
| D158,653 | S * | 5/1950 | Fenlason | D2/916 |
| 4,506,460 | A | 3/1985 | Rudy | |
| 5,185,943 | A | 2/1993 | Tong et al. | |
| 5,678,329 | A * | 10/1997 | Griffin et al. | 36/50.1 |
| 5,692,319 | A | 12/1997 | Parker et al. | |
| 5,896,683 | A | 4/1999 | Foxen et al. | |
| 5,915,820 | A | 6/1999 | Kraeuter et al. | |
| 6,029,376 | A | 2/2000 | Cass | |
| 6,119,373 | A | 9/2000 | Gebhard et al. | |
| 6,237,251 | B1 | 5/2001 | Litchfield et al. | |
| 6,438,873 | B1 | 8/2002 | Gebhard et al. | |
| 7,124,519 | B2 | 10/2006 | Issler | |
| D532,189 | S | 11/2006 | Truelsen | |
| 7,287,342 | B2 * | 10/2007 | Keen | 36/50.1 |
| D558,964 | S | 1/2008 | Truelsen | |
| 7,421,805 | B2 | 9/2008 | Geer | |
| 2005/0034328 | A1 | 2/2005 | Geer | |
| 2005/0132615 | A1 | 6/2005 | Potter et al. | |
| 2005/0217145 | A1 | 10/2005 | Miyauchi et al. | |
| 2005/0278980 | A1 | 12/2005 | Berend et al. | |

OTHER PUBLICATIONS

Apr. 1, 2011 Office Action issued in corresponding Chinese Application No. 200880111623.9.
International Preliminary Report on Patentability and Written Opinion mailed Apr. 22, 2010 in corresponding PCT/US2008/078588.

(Continued)

*Primary Examiner* — Ted Kavanaugh
(74) *Attorney, Agent, or Firm* — Banner & Witcoff, Ltd.

(57) ABSTRACT

An article of footwear which includes a midsole and foot stabilizer. The foot stabilizer includes a longitudinally extending spine portion and a plurality of ribs extending laterally therefrom from opposing lateral and medial sides. The plurality of ribs being positioned to at least partially underlie a foot of a user. The spine portion is disposed above and affixed to the midsole and the ribs are contoured to partially enclose the foot of the user.

1 Claim, 10 Drawing Sheets

(56) References Cited

OTHER PUBLICATIONS

International Search Report in corresponding PCT Application, International Application No. PCT/US2008/078588, mailed Dec. 23, 2008.

Article 94(3) EPC Communication dated Oct. 10, 2012 from counterpart EP Appln. No. 08837341.0.

Feb. 29, 2012 Office Action issued in related Chinese Application No. 200880111623.9, English translation only.

* cited by examiner

FOOTWEAR WITH A FOOT STABILIZER

CROSS-REFERENCE TO RELATED APPLICATION

This application is a divisional of co-pending U.S. patent application Ser. No. 11/869,511 filed on Oct. 9, 2007, the contents of which are incorporated herein by reference in their entirety.

FIELD OF THE INVENTION

This invention relates generally to an article of footwear, and, in particular, to an article of footwear with a foot stabilizer.

BACKGROUND OF THE INVENTION

Conventional articles of athletic footwear include two primary elements, an upper and a sole structure. The upper provides a covering for the foot that comfortably receives and securely positions the foot with respect to the sole structure. The sole structure is secured to a lower portion of the upper and is generally positioned between the foot and the ground. The sole structure may provide cushioning, traction, and wear resistance. Accordingly, the upper and the sole structure operate cooperatively to provide a comfortable structure that is suited for a wide variety of activities.

Known sole structures have incorporated multiple layers that are conventionally referred to as an insole, a midsole, and an outsole. The insole is a thin, compressible member located within the upper and adjacent to a plantar (i.e., lower) surface of the foot to enhance footwear comfort. The midsole, which is conventionally secured to the upper along the length of the upper, forms a middle layer of the sole structure and is primarily responsible for attenuating ground reaction forces. One known midsole is primarily formed from a resilient, polymer foam material that extends throughout the length of the footwear. In addition to polymer foam materials, existing midsoles have other elements, for example, one or more fluid-filled bladders and moderators. The outsole forms the ground-contacting element of footwear and is usually fashioned from a durable, wear-resistant material that includes texturing to improve traction.

Athletic activities may require frequent and quick lateral bodily movements. Sports such as tennis and basketball are examples of athletic activities which require such dynamic lateral movements. The lateral movements require a secure foot plant to maintain stability. Without a secure footing, injuries can occur. Therefore, when performing such athletic activities, footwear which will provide lateral constraint for the foot during such lateral movements is highly desirable. Hence, in order to reduce the risk of injuries, footwear to be worn during such activities should incorporate features that emphasize lateral constraint. While lateral constraint is one factor to be considered in designing athletic footwear, another factor is the weight of the athletic footwear. In general, it is desirable to make the athletic footwear lightweight. Therefore, it would be desirable for an article of athletic footwear to be lightweight while still providing adequate lateral constraint.

Particular objects and advantages will be apparent to those skilled in the art, that is, those who are knowledgeable or experienced in this field of technology, in view of the following disclosure of the invention and detailed description of certain embodiments.

SUMMARY OF THE INVENTION

This invention pertains to an article of footwear and, in particular, to an article of footwear with a foot stabilizer.

One aspect of this invention is directed to an article of footwear. The article of footwear includes a midsole and foot stabilizer. The foot stabilizer includes a longitudinally extending spine portion and a plurality of ribs extending laterally therefrom from opposing lateral and medial sides. The ribs are positioned to at least partially underlie a foot of a user. The spine portion is disposed above and affixed to the midsole and the ribs are contoured to partially enclose the foot of the user.

Another aspect of this invention is directed to a foot stabilizer. The foot stabilizer includes a spine and a plurality of ribs including a first set of ribs and a second set of ribs. The first set is disposed on and extending from a lateral side of the spine and the second set disposed on and extending from a medial side of the spine. The plurality ribs is contoured to substantially enclose and provide lateral support to a foot. The foot stabilizer also includes a plurality of slots which extend into the spine and wherein the slots are positioned between the ribs so as to separate the individual ribs from each other.

Another aspect of this invention is directed to an article of footwear with a midsole and a foot stabilizer including a plurality of ribs extending laterally from each opposing lateral and medial side of the foot stabilizer. The ribs are positioned to partially underlie a foot of a user and contoured to partially enclose the foot of the user. The foot stabilizer also includes a plurality of slots in the foot stabilizer wherein the slots are positioned between the ribs so as to separate the individual ribs from each other. Also, the footwear has a plurality of grooves disposed in said midsole wherein the grooves are positioned between or adjacent each rib so that the grooves and ribs alternate along a longitudinal direction of the footwear.

These and additional features and advantages of the invention disclosed here will be further understood from the following detailed disclosure of certain preferred embodiments.

DETAILED DESCRIPTION OF CERTAIN PREFERRED EMBODIMENTS

The following discussion and accompanying figures disclose a foot stabilizer 10 in accordance with the present invention. The foot stabilizer 10 may be incorporated into any style of footwear including, for example, athletic footwear. The foot stabilizer 10 may be configured to provide lateral support to the foot of a user in sports requiring dynamic movement. Although the embodiments illustrated herein depict a foot stabilizer 10 as incorporated into athletic footwear, the present invention is not to be restricted to athletic footwear, and could, in fact, be incorporated into any style of footwear. For example, while lateral constraint may be useful for athletic footwear, due to the frequent and quick lateral bodily movements of athletics, it will also be useful in other types of footwear which are not designed specifically for athletics. Further, it is understood that other embodiments may be utilized and structural and functional modifications may be made without departing from the scope of the present invention.

Figure 1:
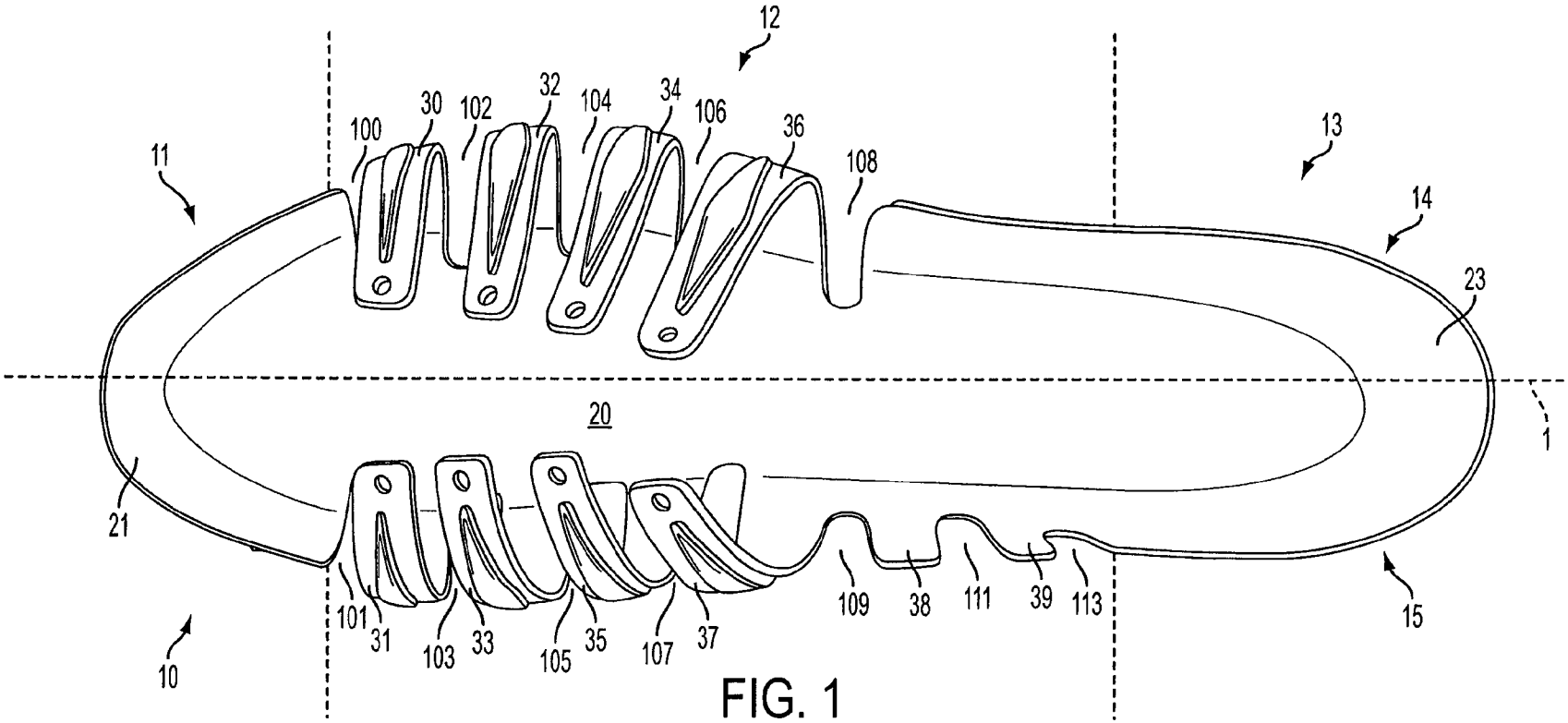
FIG. 1 is a top view of an illustrative embodiment of a foot stabilizer.

For purposes of general reference, and as can be seen in FIG. 1, the foot stabilizer 10 may be divided into three regions: a toe region 11, a midfoot region 12, and a heel region 13. Toe region 11 generally includes portions of the foot stabilizer corresponding with the toes and the joints connecting the metatarsals with the phalanges of the foot of the wearer. Midfoot region 12 generally includes portions of the foot stabilizer corresponding with the arch area of the foot. Heel region 13 corresponds with rear portions of the foot, including the calcaneus bone. The regions 11, 12, and 13, even as shown in FIG. 1, are intended to demarcate general areas of the foot stabilizer 10 as they correspond to the general areas of the foot of the wearer that would interface with the foot stabilizer 10, and to provide a frame of reference to explain the stabilizer 10.

The foot stabilizer 10 includes a lateral side 14 and medial side 15 which extend through each of the regions 11, 12, 13. More particularly, the lateral side 14 corresponds with the side of the foot that includes the fifth metatarsal and fifth distal, medial, and proximal phalanges (i.e. the outside of the foot), whereas the medial side 15 corresponds with a side of the foot that includes the first metatarsal and hallux (i.e. the inside of the foot).

FIGS. 1-5 illustrate an embodiment of the foot stabilizer 10. Referring to FIG. 1, the foot stabilizer 10 includes ribs 30-37 positioned at the lateral side 14 and medial side 15 of the foot stabilizer 10 and a longitudinally extending spine portion 20 therebetween. As shown in the illustrative embodiment of FIG. 1, the ribs 30-37 extend from the spine portion 20 of the foot stabilizer 10, such that a portion of the ribs 30-37 will underlie or extend underneath the sides of the foot of a user. Further, as shown in the illustrative embodiment of FIG. 1, the ribs 30-37 are configured to conform to the shape of the foot and are also shaped to substantially enclose the foot of a user. For example, in the depicted illustrative embodiment, the ribs 30-37 extend initially laterally away from the spine 20 and then curve upward and inward. In an alternative arrangement, the ribs 30-37 may be shorter and terminate lower but still be long enough so that adequate lateral support is provided. In the illustrative depicted embodiment, the ribs 30-37 terminate where the distal ends of the ribs 30-37 are substantially above the top of the foot. In this way, the ribs 30-37 substantially enclose the foot. While eight ribs 30-37 are shown in the depicted embodiment, the foot stabilizer 10 may include more or less than eight ribs. Also, while the depicted illustrative embodiment shows the ribs in pairs, this is not required. Additionally, the ribs 30-37 can be different sizes, widths, curvatures, thicknesses, stiffnesses, etc.

The foot stabilizer can be made of any suitable material that may provide sufficient lateral constraint while still allowing flexibility. Examples of such materials include polymers, rubbers, plastics, elastomeric materials, etc.

Figure 3:
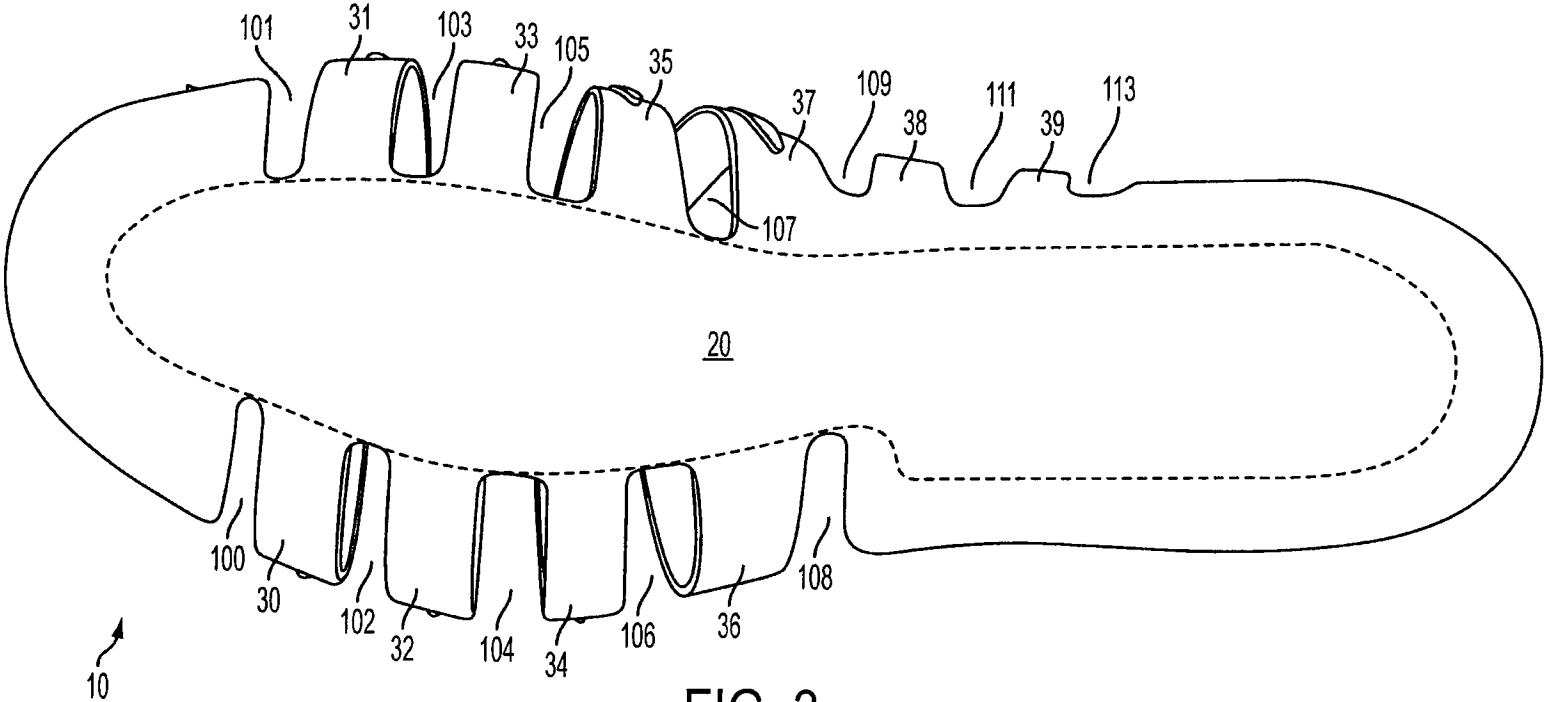
FIG. 3 is a bottom view of the foot stabilizer of FIG. 1.
Figure 4:
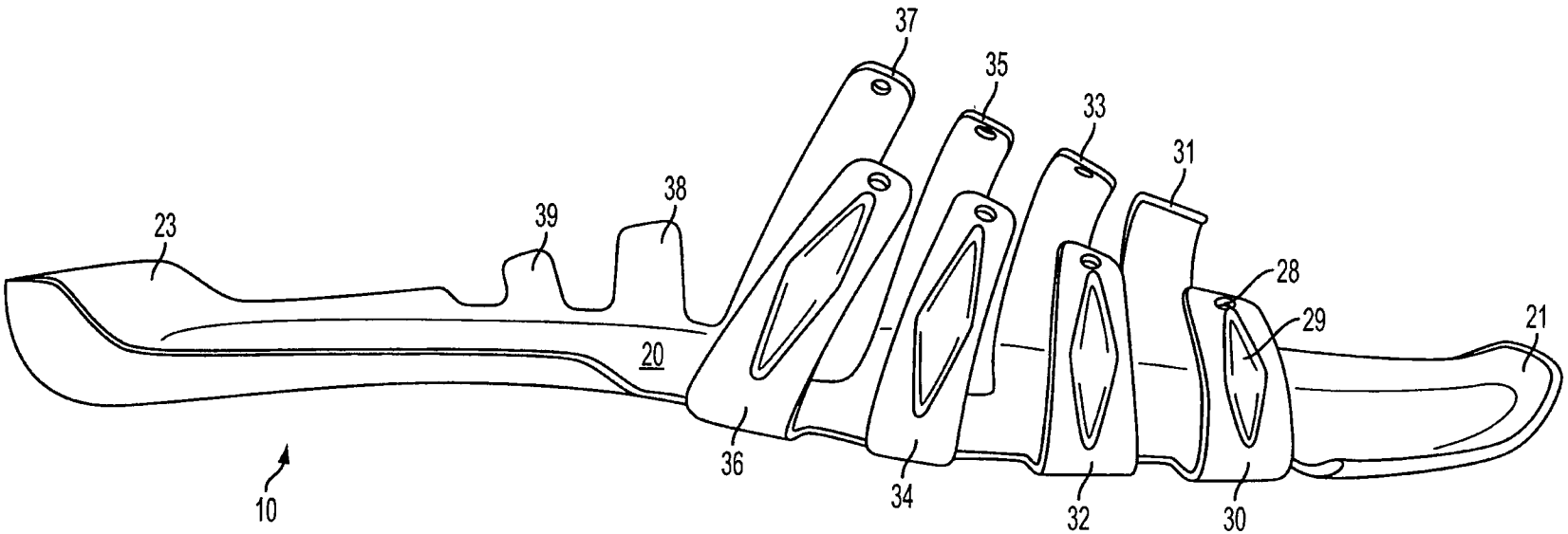
FIG. 4 is a lateral side view of the foot stabilizer of FIG. 1.

In FIG. 3, the bottom of the foot stabilizer 10 is shown. As can be seen in this illustrative embodiment, there slots 100-109, 111, 113 between the ribs 30-37 extend into the bottom of the foot stabilizer 10. These slots 100-109, 111 and 113 provide the foot stabilizer with flexibility. By including the slots 100-109, 111 and 113 in the foot stabilizer 10 the foot stabilizer 10 is able to bend and flex more readily than if the foot stabilizer 10 did not include the slots. The dimensions of these slots may be selected to provide the desired flexibility of the sole in the regions between the ribs. Further, the variations in the dimensions of the slots need not be uniform to all the slots. For example, some slots may extend farther into the bottom portion that other slots. As a result, some areas of the foot stabilizer 10 may be more flexible than other areas of the foot stabilizer 10.

The ribs 30-37 may each include a stiffening member 29 positioned on the exterior face of the ribs 30-37. If desired, the stiffening member 29 can provide desired bending properties for the ribs 30-37 by providing additional stiffness to the ribs 30-37 in selected regions. The stiffening member 29 along the length of the rib can therefore aid in providing a desired balance between a flexible and stiff rib. The stiffening member 29 may be integrally formed with the ribs 30-37 by molding or attached by any technique known in the art, such as adhesives, etc. This stiffening member 29 may alter the bending moment of the rib. As seen in the illustrative embodiment of FIG. 4, the stiffening member 29 is diamond-shaped. The diamond shape provides the advantage that the amount of stiffening is varied along the length of the rib. Due to its inherent shape, the middle of the diamond has more stiffening material than the tips of the diamond. Therefore, the middle of the diamond provides increased stiffness than the tips of the diamond and further the amount of stiffness will vary from the middle to the tip in accordance with the diamond shape. Hence, when the diamond shaped stiffening member 29 is positioned on the rib, there will be increased stiffness at the portion of the rib where the middle of the diamond is located and less stiffness at the portion of the rib where the tips of the diamond are located. In the depicted embodiment, due to the diamond shape, the ends of the ribs 30-37 are less stiff and the middle portion of the ribs 30-37 are stiffer. However, the stiffening member need not be diamond shaped. Instead, the stiffening member 29 may be formed in any suitable shape. The characteristics of the stiffening member 29 can be designed, as needed, to affect the flexibility of the rib. For example, the thickness, width, length, shape, stiffness, material, etc. of the stiffening member 29 can be varied to provide the rib with the desired lateral stability. Further, since each rib has its own stiffening member 29, the characteristics of the stiffening members 29 need not be uniform to all the stiffening members. In other words, a first rib 30 could have a first stiffening member 29 which particular characteristics, while another rib 32 could have a second stiffening member which has different characteristics than the first stiffening member 29. In this way, the individual ribs 30-37 may be provided with different flexibilities.

The ribs 30-37 may include eyelet openings 28. The eyelet openings 28 may be used to receive a shoe lace as part of a fastening system. The lace may be tied in accordance with known techniques.

The foot stabilizer 10 may also include one or more arch support extensions 38, 39 to add extra support to the arch of a foot of a user. Additionally, these arch support extensions 38, 39 can provide torsional rigidity to the foot stabilizer 10. The illustrative embodiment shown in FIG. 1, discloses two arch support extensions 38 and 39 positioned on the medial side 15 of the foot stabilizer 10 at the midfoot region 12. Further, while the arch support extensions 38, 39 may be formed as extensions protruding from the medial side 14 of the foot stabilizer 10, this is merely one embodiment and the arch support extensions may be provided in other ways.

Figure 2:
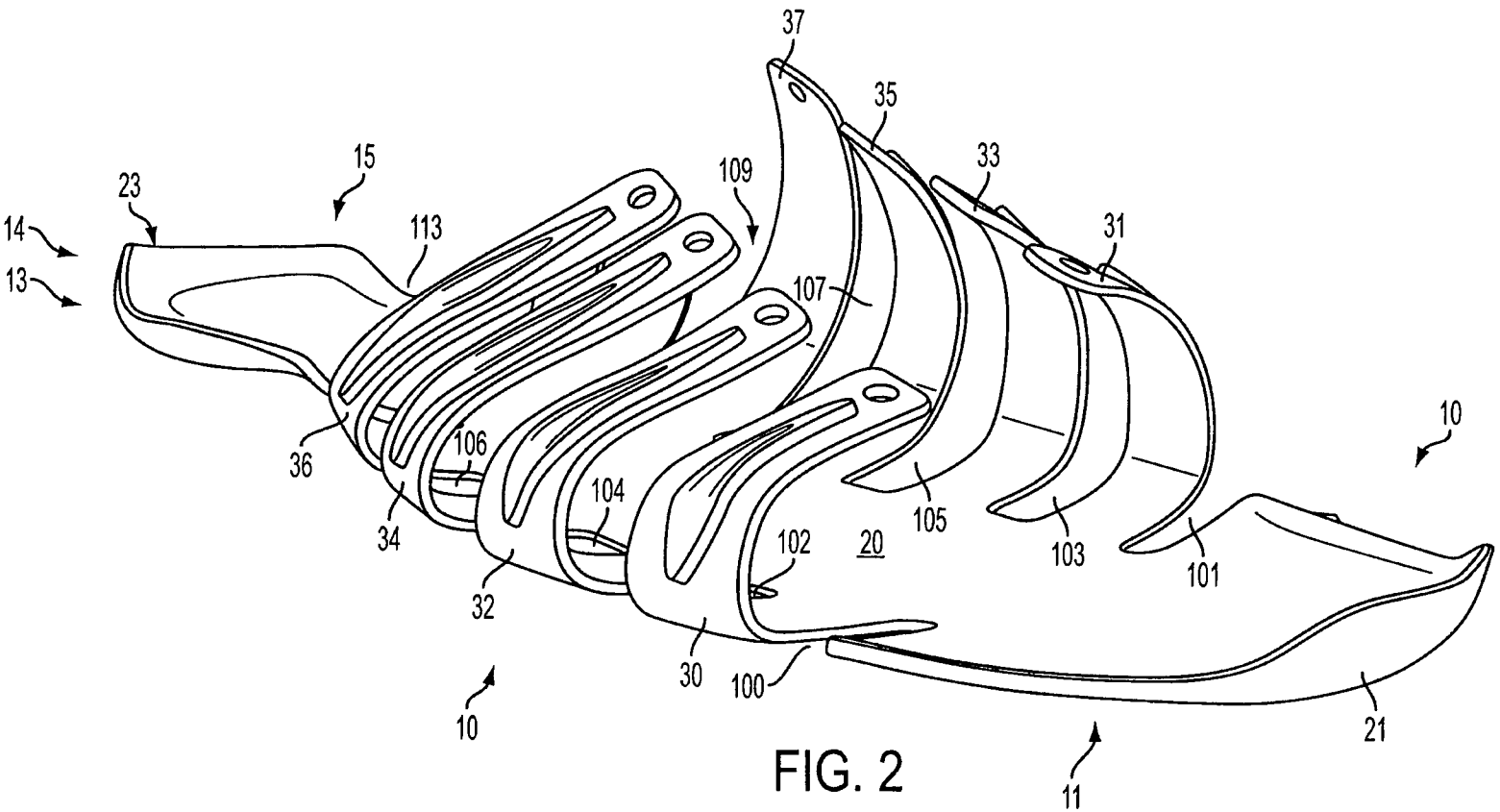
FIG. 2 is a front perspective view of the foot stabilizer of FIG. 1.

In addition to ribs 30-37, the foot stabilizer can also include other elements configured to position the foot of a user. For example, as shown in FIG. 2, the foot stabilizer 10 may also include a heel counter 23 disposed in the rearfoot region of the foot stabilizer 10. The heel counter 23 is a raised portion which extends up the back and side of the heel and is shaped to engage and stabilize the heel of the user. Also, as shown in FIG. 2, the foot stabilizer may include a raised toe portion 21 positioned in the forefoot region 11 of the foot stabilizer 10 and extends up in front or along the sides of one or more toes. The raised toe portion 21 may be shaped to engage and stabilize the front of the user foot including the toes.

The foot stabilizer 10 is incorporated into an article of footwear. An illustrative embodiment of such an article of footwear with the foot stabilizer 10 incorporated is shown in FIGS. 5-8. The embodiment shown in FIGS. 5-8 is merely illustrative. As seen in the illustrative embodiment of those figures, the article of footwear includes an upper 50 and a sole 80. As can be seen in FIG. 6, the sole may be comprised of an outsole 60 and a midsole 40. Further, as can be seen in FIG. 5A, the midsole 40 may be comprised of a midsole upper 40A and a midsole lower 40B.

Figure 9:
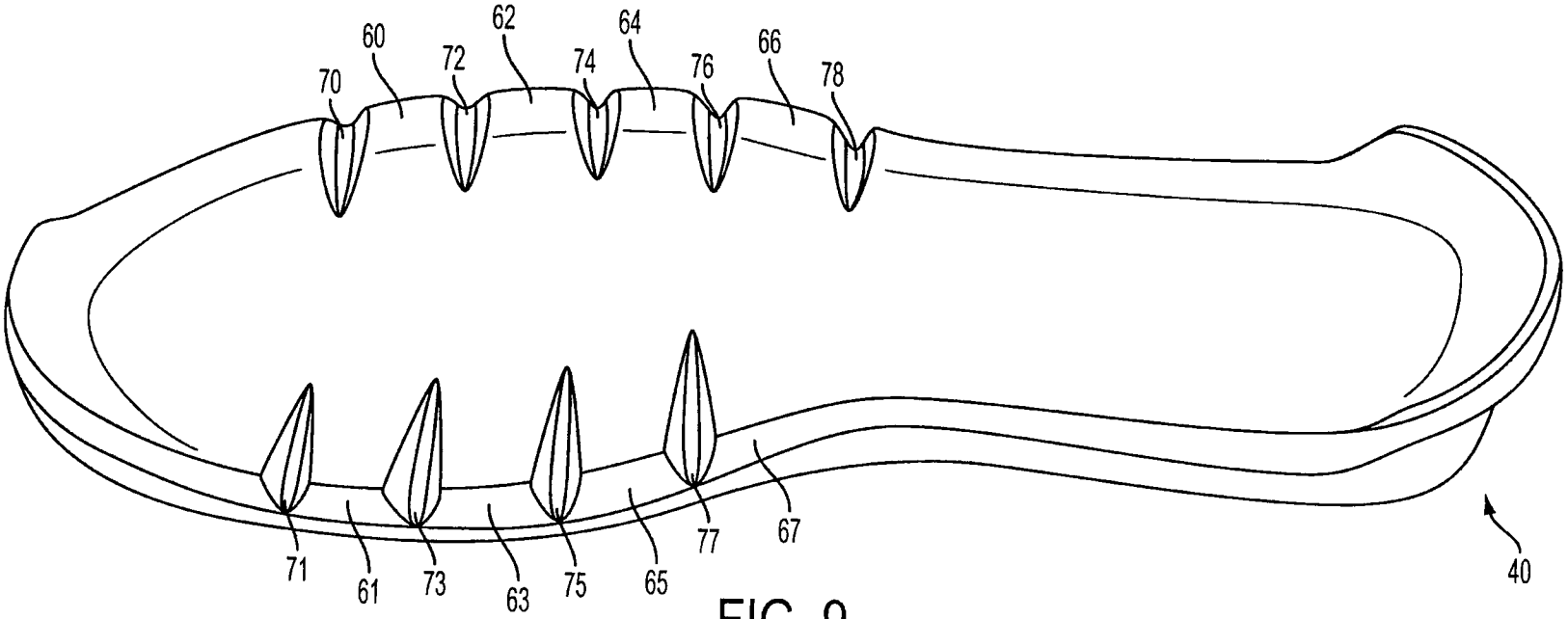
FIG. 9 is a perspective view of an illustrative embodiment of a midsole usable with the foot stabilizer of FIG. 1.

The midsole 40 may have a series of grooves 70-78 positioned on the lateral 14 and medial 15 sides of the midsole 40. In the illustrated embodiment shown in FIGS. 5A and 5B the grooves 70-78 are shown as triangular notches. While the grooves 70-78 may have this depicted configuration as the grooves 70-78 may have alternative configurations such as rectangular or semicircular shaped notches. As shown in FIG. 5B, the width and the height of the grooves 70-78 are signified as $G_W$ and $G_T$ respectively. As shown in FIG. 9, the grooves 71, 73, 75 and 77 on the medial side 15 define a series of tabs 61, 63, 65 and 67. The tabs 61, 63, 65 and 67 on the medial side 15 of the midsole are positioned between the grooves 71, 73, 75 and 77. Similarly, the grooves 70, 72, 74, 76 and 78 on the lateral side 14 define a series of tabs 60, 62, 64 and 66. The tabs 60, 62, 64 and 66 on the lateral side 14 of the midsole are positioned between the grooves 70, 72, 74, 76 and 78.

The grooves 70-78 of the midsole 40 may correspond to the slots of the foot stabilizer 10 so as together the grooves 70-78 and slots provide flexibility to the footwear. The grooves 70-78 may be dimensioned to provide such flexibility. Further the grooves 70-78 may be positioned between or adjacent each rib so that the grooves 70-78 and ribs 30-37 alternate along a longitudinal direction of the footwear. In one embodiment the depth/height of the grooves may be anywhere from 0.5 to 1.5 times the width of the groove. For example, if the width of the groove is 1 centimeter the height may be 0.5-1.5 centimeters. The width and height of the grooves may range from 1 mm to 50 mm or more. In the depicted embodiment some the larger grooves may have heights of 6-10 mm while other grooves which are smaller may have heights of 3-6 mm. Further, the widths of the grooves may have similar ranges such as 3 mm to 10 mm. These ranges for the height and widths are provided merely as examples to aid the reader in understanding the disclosure.

Figure 5A:
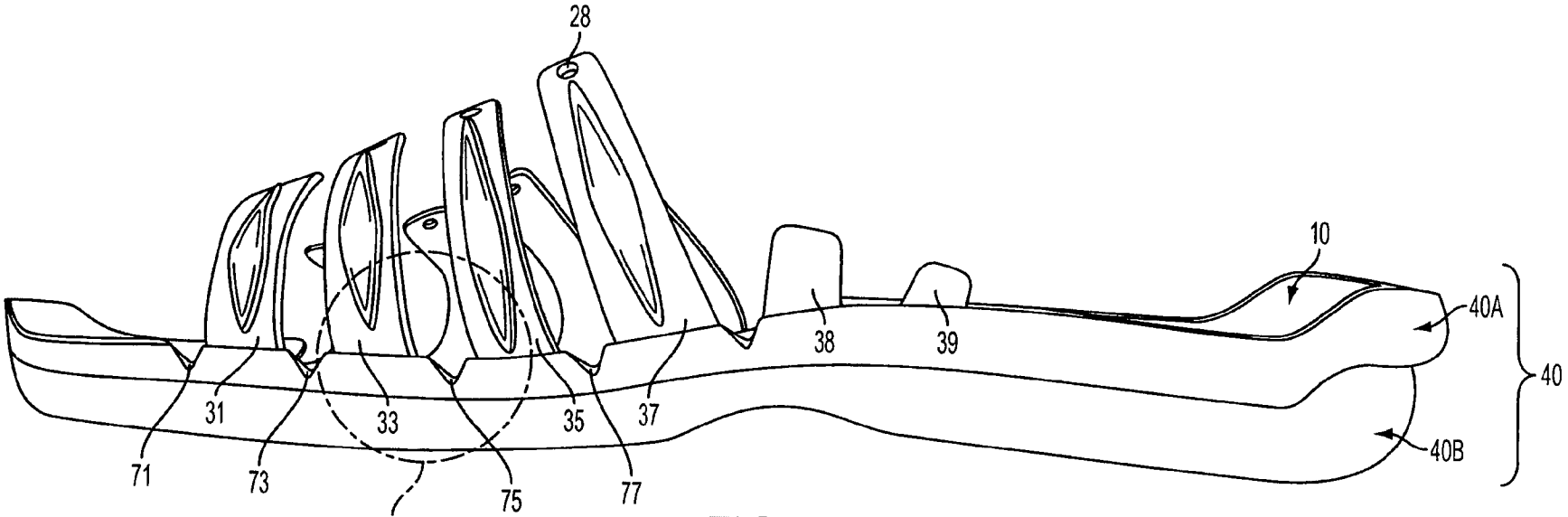
FIG. 5 is a medial side view of the foot stabilizer of FIG. 1 with a midsole attached.
FIG. 5B is an enlarged side view of a portion of FIG. 5A.
Figure 5B:
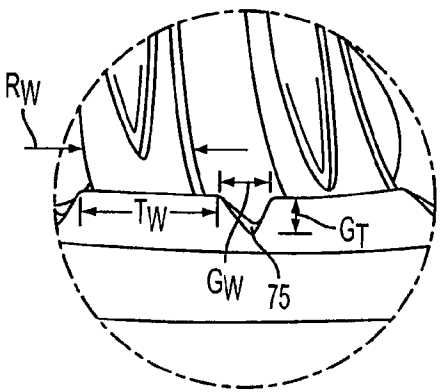
Figure 6:
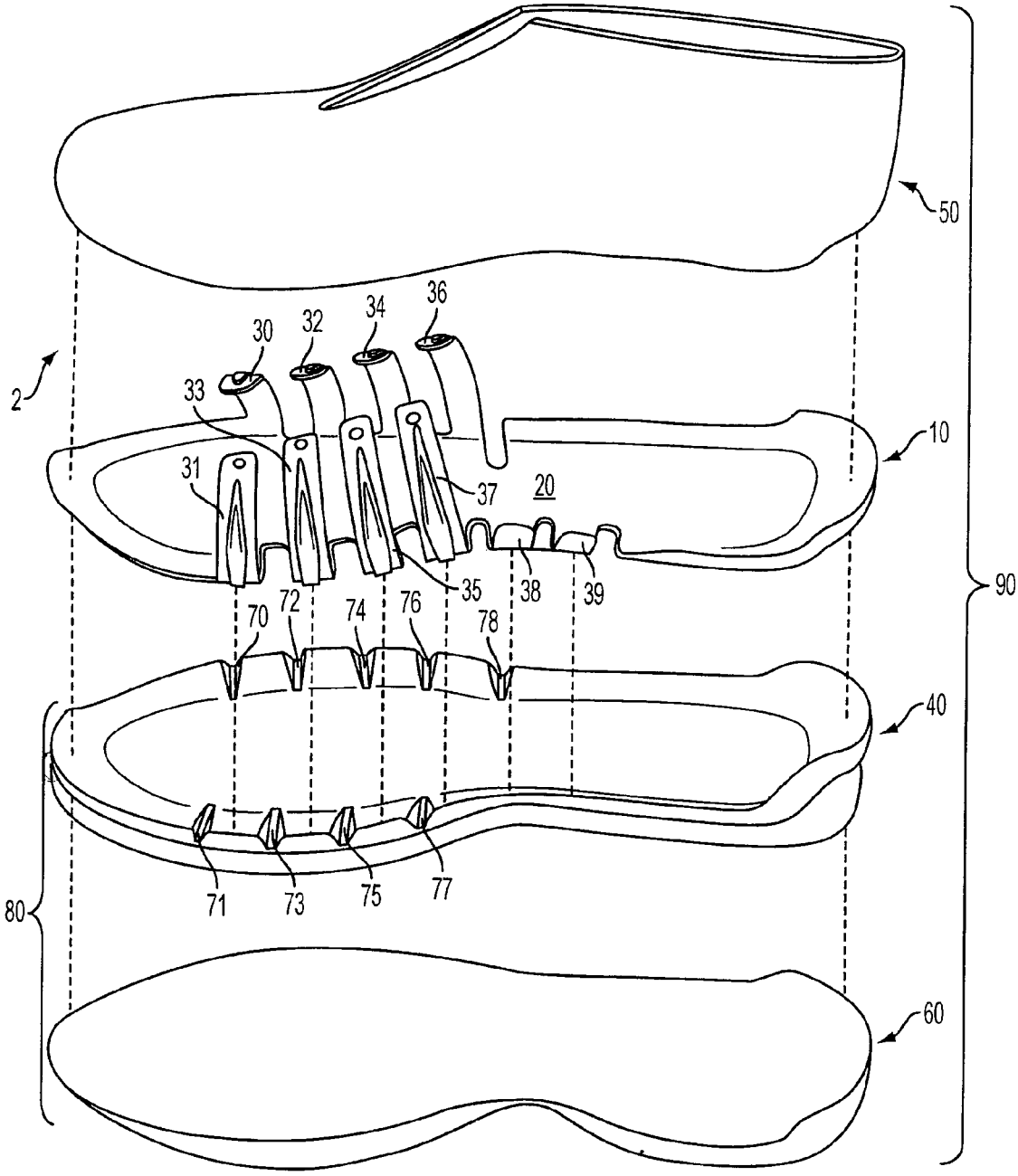
FIG. 6 is an exploded view of an illustrative embodiment of an article of footwear incorporating the foot stabilizer of FIG. 1.

Also, as seen in FIG. 5A, the upper portion of the midsole 40A may be attached directly to the bottom of the foot stabilizer 10. It may be attached in any of known ways, such as adhesive, etc. In this arrangement illustrated in FIGS. 5A and 6, the tabs 60-67 of the midsole 40 correspond to the ribs 70-78 of the foot stabilizer 10. As shown in FIG. 5B, each of the tabs 60-67 has a width $T_W$ which is equal to or larger than the width $R_W$ of each respective rib to which that tab corresponds. The tabs 60-67 buttress and provide support to the ribs 70-78.

FIG. 6 shows an exploded view of the article of footwear with the foot stabilizer 10 incorporated. As described above, the upper portion of the midsole 40A may be attached directly to the foot stabilizer 10. Further, the midsole 40 may be secured to the outsole 60 by any suitable means including, for example, an adhesive. Further, the upper 50 may be attached to the sole 80 by any suitable means such as stitching or adhesive. Additionally, an insole layer, as shown in FIG. 8B, may be disposed atop the foot stabilizer 10 to enhance the comfort of the foot of a user.

Figure 7:
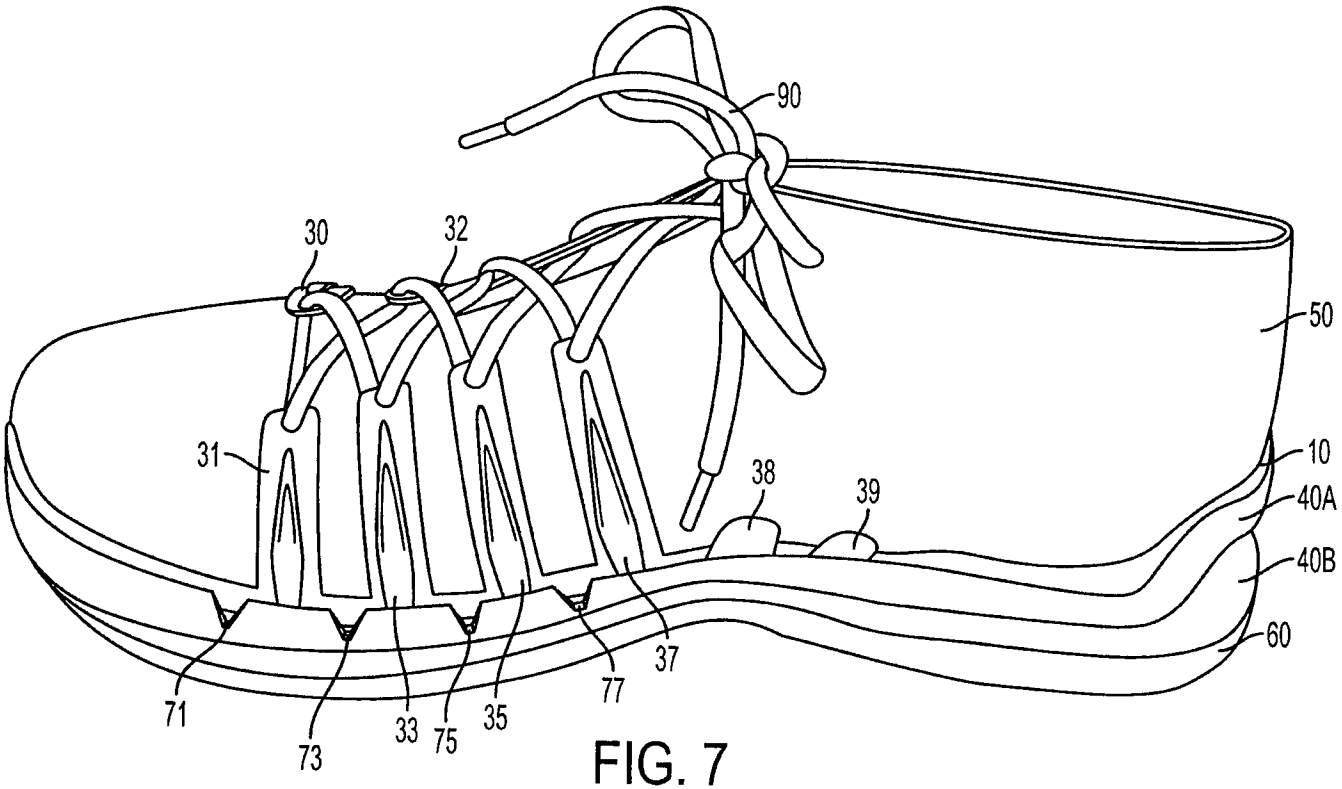
FIG. 7 is a side perspective view of the article of footwear of FIG. 6 in an assembled state with laces.
Figure 8A:
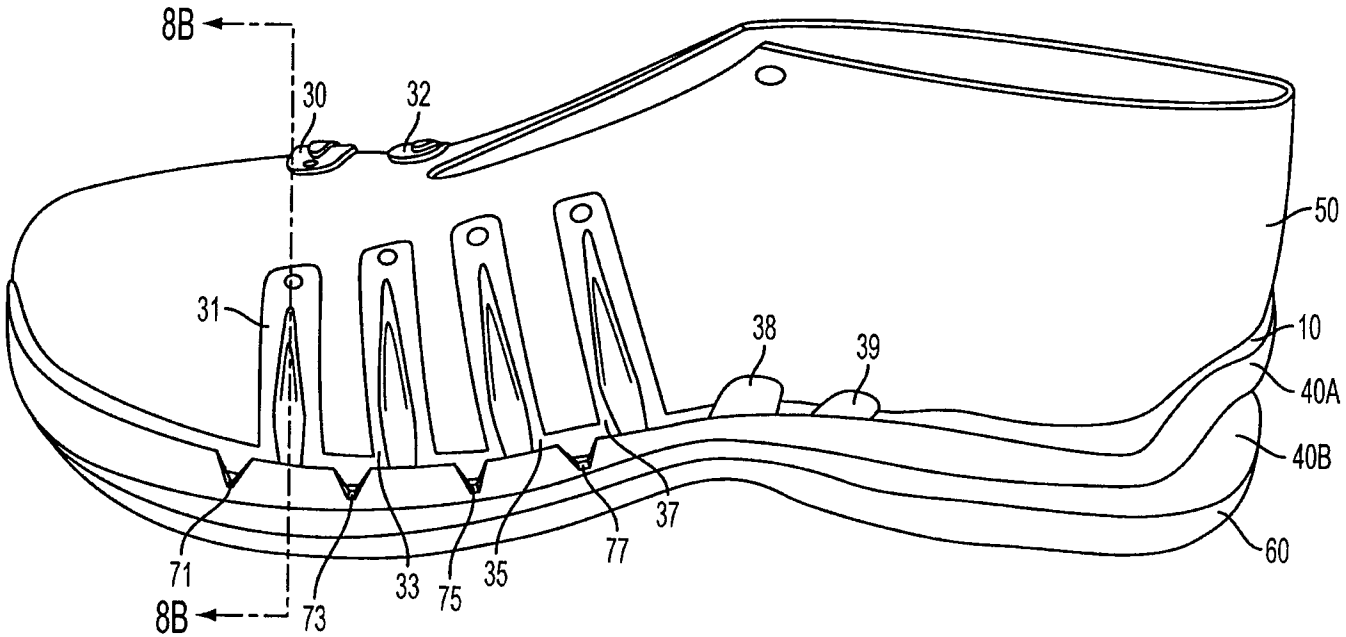
FIG. 8A is a side perspective view of the article of footwear of FIG. 7 in an assembled state without the laces.
Figure 8B:
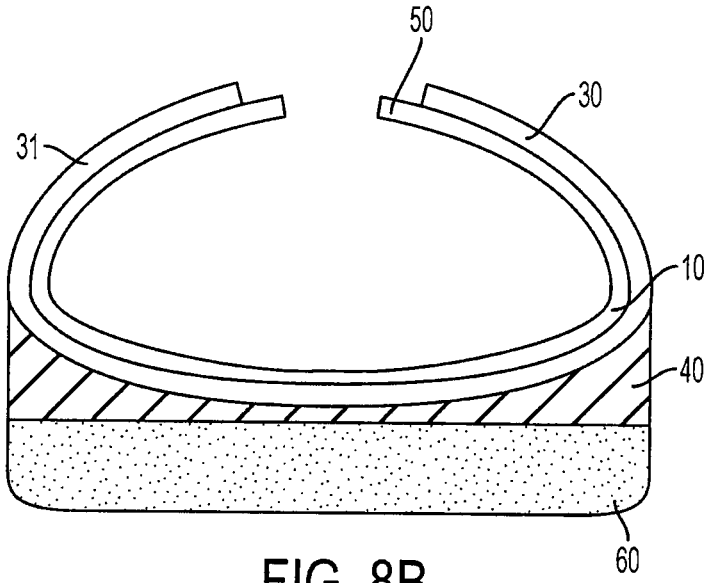
FIG. 8B is a cross-sectional view taken on line 8B of FIG. 8A.

Further, as seen in FIGS. 7-8, the ribs 30-37 of the foot stabilizer are positioned around the outer surface of the upper. In this way, the foot stabilizer 10 provides support against the lateral movement of the foot. The ribs 30-37 may optionally be attached to the sides of the upper 50. In other words, the ribs may be adhered to the upper via adhesive or other methods or alternatively the ribs may not be adhered to the upper at all. For example, in a particular embodiment, the upper 50 can comprise a bootie that is disposed within, but not attached to the ribs 30-37 of the foot stabilizer. As described above, the ribs 30-37 may include eyelet holes 28 to receive laces 90 and therefore in this embodiment, where the ribs 30-37 are not attached to the upper, the laces 90 will aid in securing the ribs 30-37 around the upper 50. In alternative embodiments no laces are required and instead other attaching or fastening techniques may be used. As long as the ribs provide the adequate lateral support, the embodiments, laced or without laces, etc. are included within the scope of the invention.

As mentioned above, athletic footwear which is lightweight may be desirable. Therefore, since the foot stabilizer 10 provides lateral support, the upper 50 itself does not have to provide as much lateral support as the upper 50 normally would without the foot stabilizer 10. Hence, the upper 50 can be created with minimal material. For example, the upper 50 can be made of a material that is of lighter weight than would otherwise be the case. Therefore, the overall weight of the entire footwear is reduced while still providing adequate lateral stability. This may be especially beneficial in athletic footwear designed for a sport such as tennis. In tennis the footwear should be light due to the large amount of running that may be involved, but yet the footwear must also provide adequate lateral support due to the frequent and quick lateral stops the sport of tennis requires. Additionally, such footwear would be beneficial in basketball and other sports that involve quick lateral movement similar movements to tennis. Also, the above described footwear may also be especially beneficial in other sports such as running. In running, it is desirable to have lightweight footwear that is able to readily flex in a direction along its longitudinal axis. The foot stabilizer's ability to flex in the direction along the lateral axis 1 of the footwear is therefore well suited for running. The foot stabilizer's slots 100-109, 111 and 113 increase the foot stabilizer's ability to flex in such a direction and hence make footwear incorporating it especially beneficial in running.

One example of a material out of which the upper 50 may be constructed is a breathable mesh material. It is noted that a material, such as breathable mesh, may not otherwise be suitable as an upper 50 because it would not, by itself, provide adequate lateral support. However, in conjunction with the foot stabilizer 10 such material could be used and the footwear would still have adequate lateral support due to the foot stabilizer 10. In other words, the lateral support provided by the foot stabilizer 10 allows the upper 50 to be constructed of ultra lightweight material and further of minimum amounts of such lightweight material. Therefore, the weight of the footwear is reduced.

However, while a lightweight material, such a breathable mesh, may be used. The upper 50 may be composed of a variety of other alternative materials. For example, the upper 50 may have construction that includes multiple layers of leather, textile, polymer, and foam elements adhesively bonded and stitched together. The interior surface may include a moisture-wicking textile for removing excess moisture from the area immediately surrounding the foot. As noted above, the configuration of upper 50 depicted here is suitable for use during athletic activities, but the upper 50 this is not required.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. A foot stabilizer comprising:

a spine; and a plurality of ribs including a first set of ribs and a second set of ribs wherein the first set is disposed on and extending from a lateral side of the spine and the second set disposed on and extending from a medial side of the spine, the plurality of ribs each including eyelet openings at their distal ends and individual stiffening members on their outer surfaces, wherein the stiffening members are integrally formed with the ribs, and wherein the ribs are contoured to substantially enclose and provide lateral support to a foot, and terminate at a distal end which is substantially over a top portion of the foot a plurality of slots which extend into the spine and wherein the slots are positioned between the ribs so as to separate the individual ribs from each other, wherein the foot stabilizer includes a toe region, a midfoot region, and a heel region, wherein the toe region includes an upwardly curved toe portion, the heel region includes an upwardly extending heel counter, the plurality of ribs is positioned at least partially at the midfoot region, and the midfoot region includes at least one upwardly extending arch support configured to provide support to the arch of a foot of a user, and wherein the first set of ribs disposed on and extending from the lateral side of the spine or the second set of ribs disposed on and extending from the medial side of the spine are not disposed in the heel region of the foot stabilizer.

* * * * *